US005416984A

United States Patent [19]

Murray

[11] Patent Number: 5,416,984

[45] Date of Patent: May 23, 1995

[54] APPARATUS AND METHOD FOR DEFLECTING A WEB

[75] Inventor: Robert R. Murray, Madbury, N.H.

[73] Assignee: Heidelberg Druckmaschinen AG, Heidelberg, Germany

[21] Appl. No.: 154,185

[22] Filed: Nov. 18, 1993

[51] Int. Cl.[6] ..... F26B 7/00

[52] U.S. Cl. ..... 34/392; 34/114; 34/117; 34/120

[58] Field of Search ..... 34/117, 120, 119, 391, 34/392, 63, 62, 652, 444, 452; 226/95

[56] References Cited

U.S. PATENT DOCUMENTS

| | | | |
|---|---|---|---|
| 3,452,447 | 7/1969 | Gardner | 34/156 |
| 3,733,711 | 5/1973 | Haythornthwaite | 34/114 |
| 4,369,584 | 1/1983 | Daane | 34/392 |
| 4,476,636 | 10/1984 | Gross | 34/114 |
| 4,513,517 | 4/1985 | Vedenpää | 34/116 |
| 5,036,600 | 8/1991 | Webster et al. | 34/113 |
| 5,111,595 | 5/1992 | Bessinger et al. | 34/18 |
| 5,174,047 | 12/1992 | Gross | 34/117 |

FOREIGN PATENT DOCUMENTS

| | | |
|---|---|---|
| 60-46250 | 3/1985 | Japan |
| 2096974 | 10/1982 | United Kingdom |

*Primary Examiner*—Denise L. Gromada
*Attorney, Agent, or Firm*—Tarolli, Sundheim & Covell

[57] ABSTRACT

An apparatus for transferring heat from a web includes a chill roll having a cylindrical outer side surface. The web moves along a path which extends part way around the chill roll. A nozzle extends between opposite edge portions of the web and extends circumferentially around a portion of the cylindrical outer side surface of the chill roll. A central portion of the nozzle directs a flow of air against a central portion of the web upstream of a location where the web normally engages the chill roll to deflect the central portion of the web into engagement with the chill roll. Opposite side portions of the nozzle extend away from the central portion of the nozzle and extend downstream from the location where the central portion of the web is deflected toward the chill roll. This results in a smoothing action which extends across the web and downstream along the web from the central portion of the web.

31 Claims, 3 Drawing Sheets

APPARATUS AND METHOD FOR DEFLECTING A WEB

BACKGROUND OF THE INVENTION

The present invention relates to an apparatus and method for use with a web and more specifically for cooling a web of printed paper.

A printing press applies ink to a web of paper as the web is moved lengthwise through the printing press. The freshly printed web is moved through a dryer and is then moved through a chill roll system in order to cool the heated web and to set the ink. The chill roll system includes a succession of chill rolls which are cooled by water circulating through the interior of the rolls.

As the paper web moves from the dryer to the chill roll system, boundary layers of air adhere to the opposite side surfaces of the moving web and are carried along with the moving web. Vaporized chemical solvents and ink residue become trapped in the boundary layers on the surfaces of the moving web as the web emerges from the dryer. The chemical solvents and ink residue are carried by the boundary layers toward the chill roll system.

The boundary layers adhering to the web surfaces are carried around the rolls in the chill roll system. The boundary layers insulate the heated surfaces of the web from the cooled surfaces of the chill rolls and inhibit heat transfer from the web to the chill rolls. Furthermore, the vaporized ink and chemical solvents in the boundary layers are deposited as residue on chill roll surfaces as the web moves through the chill roll system. Ink residue accumulating on the chill roll surfaces may be transferred back onto the web and soil the printed web surfaces which follow.

A known chill roll system for transferring heat from a web is disclosed in U.S. Pat. No. 4,476,636. This chill roll system includes a pair of small boundary layer control rolls which are disposed in sliding contact with the opposite side surfaces of the moving paper web. Each boundary layer control roll rotates in a direction opposite to the direction of the web sliding over the roll. A boundary layer carried on the web surface is squeezed off as the web slides against the boundary layer control roll.

Another known chill roll system for transferring heat from a web is disclosed in U.S. Pat. No. 5,036,600. This chill roll system includes a plurality of chill rolls which are closely spaced to define zones of interference. A boundary layer on the web sections moves through the zones of interference and is scrubbed away from the web.

Another known apparatus 10 for use in transferring heat from a web is illustrated in FIGS. 1 and 2. The prior art apparatus 10 includes a cylindrical chill roll 12 which is rotated in a clockwise direction about its central axis by a suitable drive train (not shown). The chill roll 12 has a cylindrical outer side surface 14 which is cooled, in a known manner, by circulation of water through the chill roll. A web 16 of printed paper is conducted around the chill roll 12 and moves in the direction indicated by an arrow 18 in FIG. 1.

A linear nozzle 22 (FIGS. 1 and 2) extends across the web 16. The nozzle 22 directs a jet of air against a linear area which extends across the web 16 in a direction parallel to the central axis of the chill roll 12. The linear area where the flow of air from the nozzle 22 engages the web 16 is a short distance downstream from a line of tangential engagement of the web 16 with the chill roll. The linear area where air from the nozzle 22 is applied against the web 16 extends parallel to the line of tangential engagement of the web with the chill roll 12.

With the prior art apparatus illustrated in FIGS. 1 and 2, it has been noted that on occasion there are hot strips on the web exiting from the chill roll 12. These hot strips may be at a temperature which is as much as 100° F. above the temperature of the surrounding areas. The hot strips tend to occur more often and with greater severity at higher web speeds (speeds greater than 1,500 feet per minute).

The hot strips or low heat transfer areas on the web 16 are also areas where solvent vapor condenses. The difference in solvent condensation may be more than 100 times greater at the hot strips or areas of low heat transfer than in the relatively cool or cold areas. It is theorized that the hot strips or areas of low heat transfer are due to fluid (vapor or liquid) pockets being formed between the web and the chill roll.

SUMMARY OF THE INVENTION

An improved apparatus for use with a web includes a roll. The web moves along a path which extends around the roll. A central portion of the web is deflected to engage the outer side surface of the roll upstream from areas of engagement of opposite side portions of the web with the roll. The apparatus is advantageously used with a chill roll to transfer heat from the web.

In one specific embodiment of the invention, a nozzle directs a flow of air toward the web to deflect the central portion of the web into engagement with the roll prior to engagement of opposite edge portions of the web with the roll. Opposite side portions of the nozzle extended downstream from a central portion of the nozzle to direct a flow of air against opposite edge portions of the web.

The nozzle may have a V-shaped configuration or an arcuately bowed configuration. With either configuration, the nozzle may extend part way around the chill roll and have a center of curvature which lies on the central axis of the chill roll.

BRIEF DESCRIPTION OF THE DRAWINGS

The foregoing and other features of the invention will become more apparent upon a consideration of the following description taken in connection with the accompanying drawings wherein.

DESCRIPTION OF THE SPECIFIED PREFERRED EMBODIMENTS OF THE INVENTION

General Description

Figure 1:
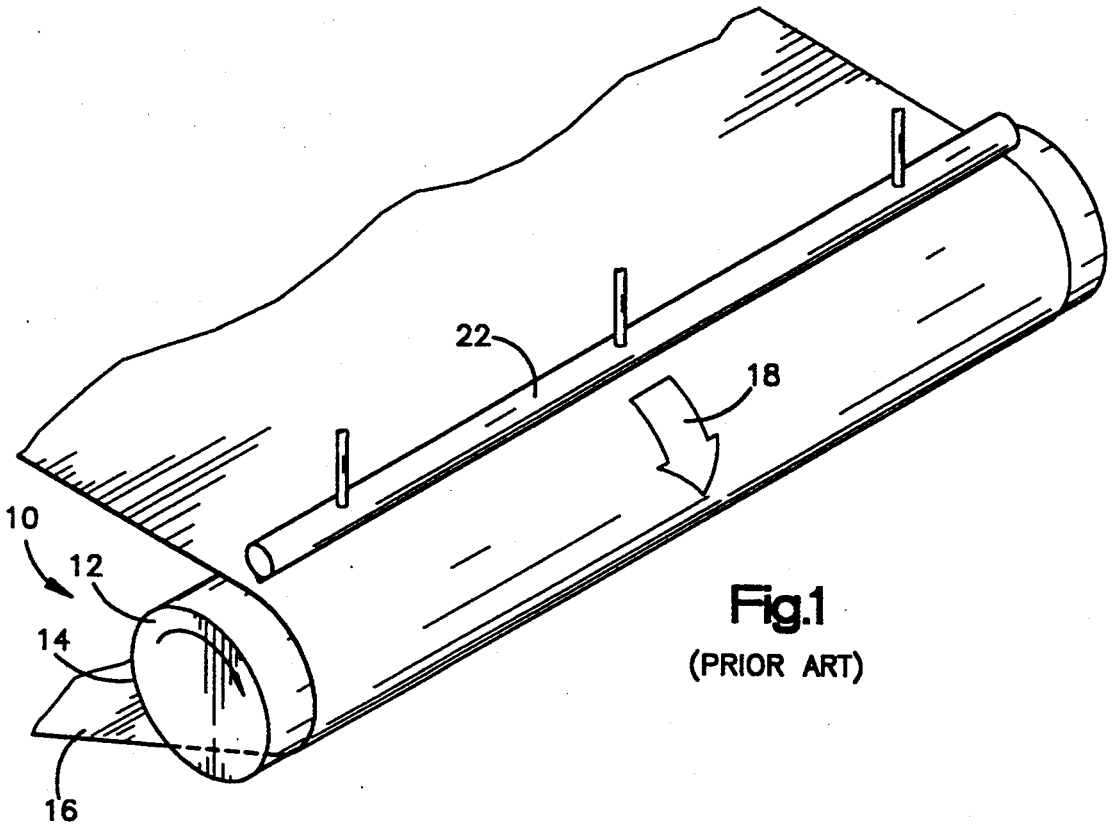
Fig.1 (PRIOR ART)
FIG. 1 is a schematic illustration of a known apparatus for use in transferring heat from a web.

An apparatus 30 (FIGS. 3 and 4) is used to transfer heat from a paper web 16. Prior to entering the apparatus 30, a printing press (not shown) prints an ink image on the web 16. The web 16 is then moved through a dryer to dry the ink on the surfaces of the web. The web 16 is then moved through the apparatus 30 in order to cool the web and to set the ink.

The apparatus 30 includes a chill roll 32 having a cylindrical outer side surface 34 which is cooled in a known manner by circulation of water through the chill roll. A motor 36 (FIG. 3) is connected with the chill roll 32 and rotates the chill roll in a clockwise direction about its central axis. Web feed rolls 38 and 40 engage the web 16 downstream from the chill roll 32 to feed the web. It should be understood that the apparatus 30 may be used for purposes other than transferring heat from a web and may be used with rolls other than the chill roll 32.

In accordance with a feature of the present invention, a central portion 44 (FIGS. 3 and 4) of the web 16 is deflected to engage the outer side surface 34 of the chill roll 32 upstream of locations where opposite edge portions 46 and 48 (FIG. 3) of the web engage the outer side surface of the chill roll. If the central portion 44 of the web 16 is not deflected, the entire web will engage the outer side surface 34 of the chill roll 32 along a line of tangency indicated schematically at 52 in FIG. 3 and referred to hereinafter as a hypothetical line of tangential engagement. However, the central portion 44 of the web 16 is deflected to engage the outer side surface 34 of the chill roll 32 upstream of the hypothetical line 52 of tangential engagement.

The straight hypothetical line 52 of tangential engagement of the web 16 with the chill roll extends parallel to a longitudinal central axis about which the chill roll 32 rotates. The actual line of engagement of the web 16 with the cylindrical outer side surface 34 of the chill roll 32 curves arcuately downward (as viewed in FIGS. 3 and 4) and forward, that is upstream, of the hypothetical line 52 of tangential engagement. However, the longitudinally extending edge portions 46 and 48 of the web 16 move into engagement with the cylindrical outer side surface 34 of the chill roll 32 along the hypothetical line 52 of tangential engagement.

Thus, the actual line of engagement of the web 16 with the outer side surface 34 of the chill roll has a curved central portion. The actual line of engagement also has straight end portions which extend in opposite directions from the central portion. The straight end portions of the actual line of engagement of the web 16 with the chill roll 32 are coincident with the hypothetical line 52 of tangential engagement.

Since the central portion 44 (FIG. 3) of the web 16 engages the chill roll 32 ahead of the opposite edge portions 46 and 48, wrinkles or pockets which extend longitudinally along the web and tend to form between the web and the chill roll 32 are smoothed outwardly from the central portion 44 of the web 16 toward the opposite edge portions 46 and 48 as the web moves into engagement with the chill roll 32. This tends to eliminate the formation of hot strips or low heat transfer areas in the web 16.

In the illustrated embodiment of the invention, moisture is applied to the web 16 ahead of the chill roll 32. The application of moisture to the web 16 weakens the strength of the paper forming the web and allows stress equalization to occur more completely across the web. It is believed that the application of moisture to the web ahead of the chill roll 32 will be particularly advantageous when the web is a light weight paper.

The moisture is applied to the web 16 ahead of the chill roll 32 by a spray bar 56. The spray bar 56 directs a fine stream or mist of water toward the web 16 in the manner indicated schematically in FIGS. 3 and 4. However, it is contemplated that other known apparatus could be utilized to apply moisture to the web. For example, rolls could be utilized to transfer moisture from a reservoir to the web.

It is contemplated that many different devices may be utilized to effect engagement of the central portion 44 of the web 16 with the outer side surface 34 of the chill roll 32 prior to engagement of the edge portions 46 and 48 with the chill roll. For example, various devices could be utilized to lift the opposite edge portions 46 and 48 of the web upwardly. These devices could include an apparatus for providing a vacuum which would tend to suck the edge portions 46 and 48 of the web upwardly. If desired, a nipping wheel could be used to create a lifting of the edge portions 46 and 48 of the web 44. It is also contemplated that a shaped airfoil contour could be utilized to effect engagement of the central portion 44 of the web with the chill roll 32 ahead of the opposite edge portions 46 and 48.

Nozzle

In accordance with a feature of the present invention, a nozzle 58 (FIGS. 4 and 5) is utilized to deflect the central portion 44 of the web at a location ahead of the hypothetical line 52 of tangential engagement of the web with the chill roll 32. The nozzle 58 directs a flow of air 60 toward the web 16 to press the web downward (as viewed in FIG. 4) against the surface 34 of the chill roll 32.

The nozzle 58 has a nonlinear configuration and applies fluid pressure against an area on the central portion 44 of the web which is upstream of the hypothetical line 52 of tangential engagement of the web with the chill roll. The nozzle 58 applies fluid pressure against the opposite edge portions 46 and 48 of the web 16 at locations which are downstream from the hypothetical line 52 of tangential engagement of the web with the chill roll 32.

Figure 4:
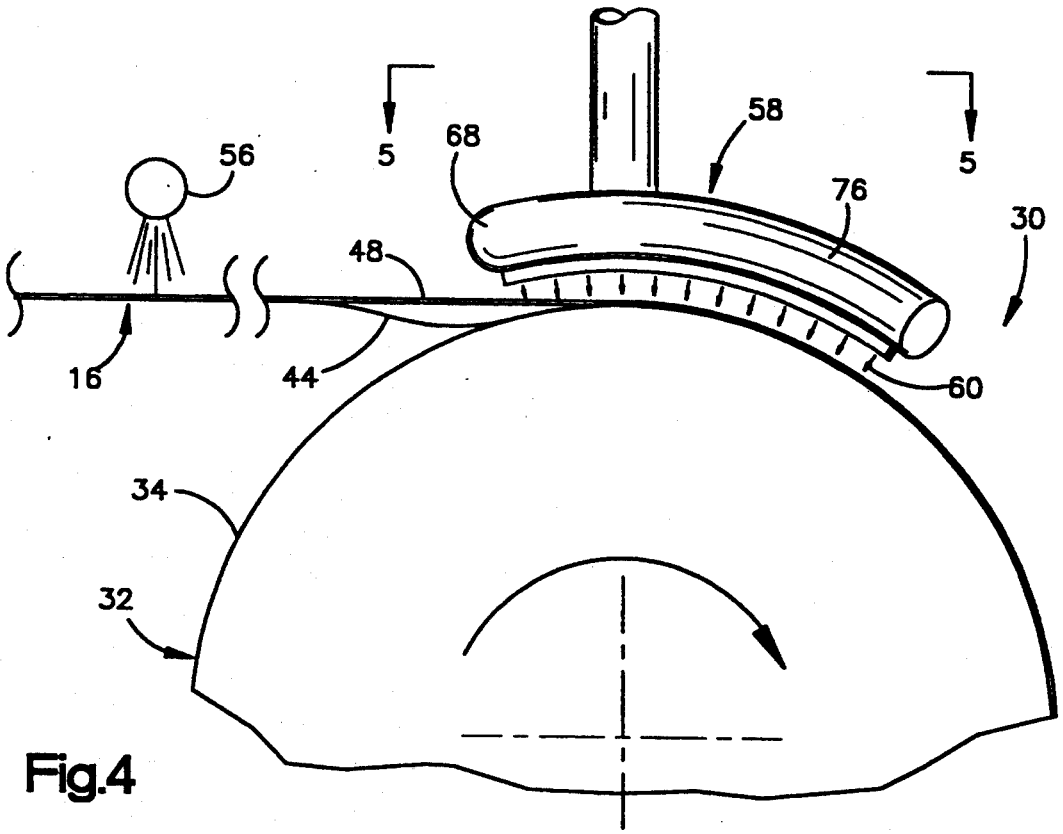
FIG. 4 is a side elevational view of the apparatus of FIG. 3 and illustrating the relationship between a web, chill roll and a nozzle.
Figure 5:
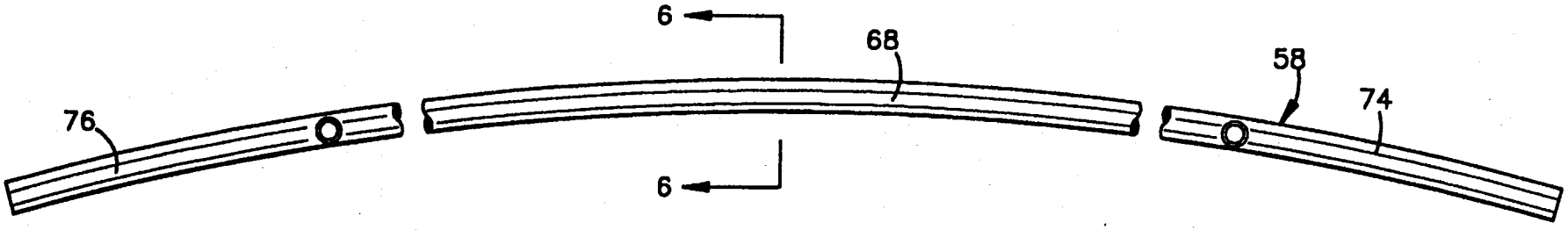
FIG. 5 is a plan view, taken generally along the line 5—5 of FIG. 4, further illustrating the construction of the nozzle.

The specific nozzle 58 illustrated in FIG. 4 has an arcuately bowed configuration when viewed in a plane extending parallel to a longitudinal central axis of the chill roll 32 (FIG. 5). A center of curvature of the nozzle 58, as viewed in FIG. 5, is disposed in a plane which extends perpendicular to the central axis of the chill roll 32 and extends through the chill roll at a location midway between opposite ends of the chill roll.

The nozzle 58 (FIG. 5) has an arcuate configuration which forms a portion of a circle. However, it is contemplated that the nozzle 58 could have an arcuately bowed configuration which would not form a segment of a circle. Thus, the nozzle 58 could have a bowed configuration (as viewed in FIG. 5) in which the nozzle has a multiplicity of centers of curvature.

Figure 2:
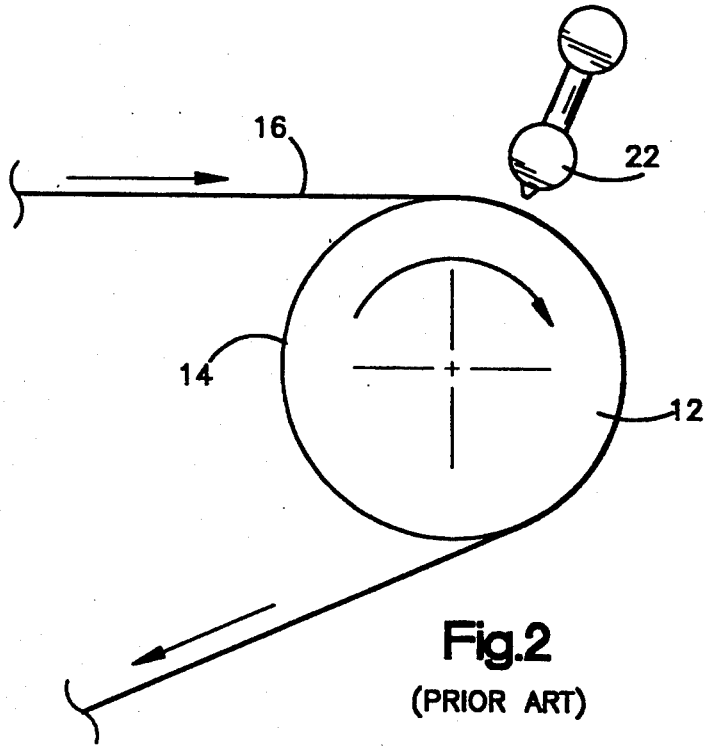
Fig.2 (PRIOR ART)
FIG. 2 is a side elevational view of the known apparatus of FIG. 1.

It is preferred to have the nozzle 58 direct air pressure against the central portion 44 of the web 16 upstream of the hypothetical line 52 of tangential engagement to maximize the web smoothing action. However, the nozzle could apply air pressure against the web 16 only at areas downstream from a line of tangential engagement of the web with the chill roll 32. Thus, the nozzle 58 could be displaced in a clockwise direction from the location shown in FIG. 4 and still obtain a smoothing action which is an improvement over the smoothing action obtained with the straight prior art nozzle 22 of FIGS. 1 and 2.

In accordance with a feature of the invention, the nozzle 58 extends circumferentially around a portion of the chill roll 32 (FIG. 4). This results in the nozzle 58 having an arcuately curved configuration as viewed in a plane extending perpendicular to the longitudinal central axis of the chill roll 32, that is, as viewed in FIG. 4. The center of curvature of the nozzle 58, as viewed in a plane extending perpendicular to the central axis of the chill roll 32 (FIG. 4), lies on the central axis of the chill roll.

The nozzle 58 is spaced from the cylindrical outer side surface 34 of the chill roll 32 by a uniform distance throughout the extent of the nozzle. This promotes the application of a uniform and radially inward pressure against the web 16 by a flow 60 of air or other gas from the nozzle 58 throughout the extent of the nozzle. The flow 60 of air from the nozzle 58 is directed radially inwardly toward the chill roll 32 in the manner shown schematically in FIG. 4.

Figure 3:
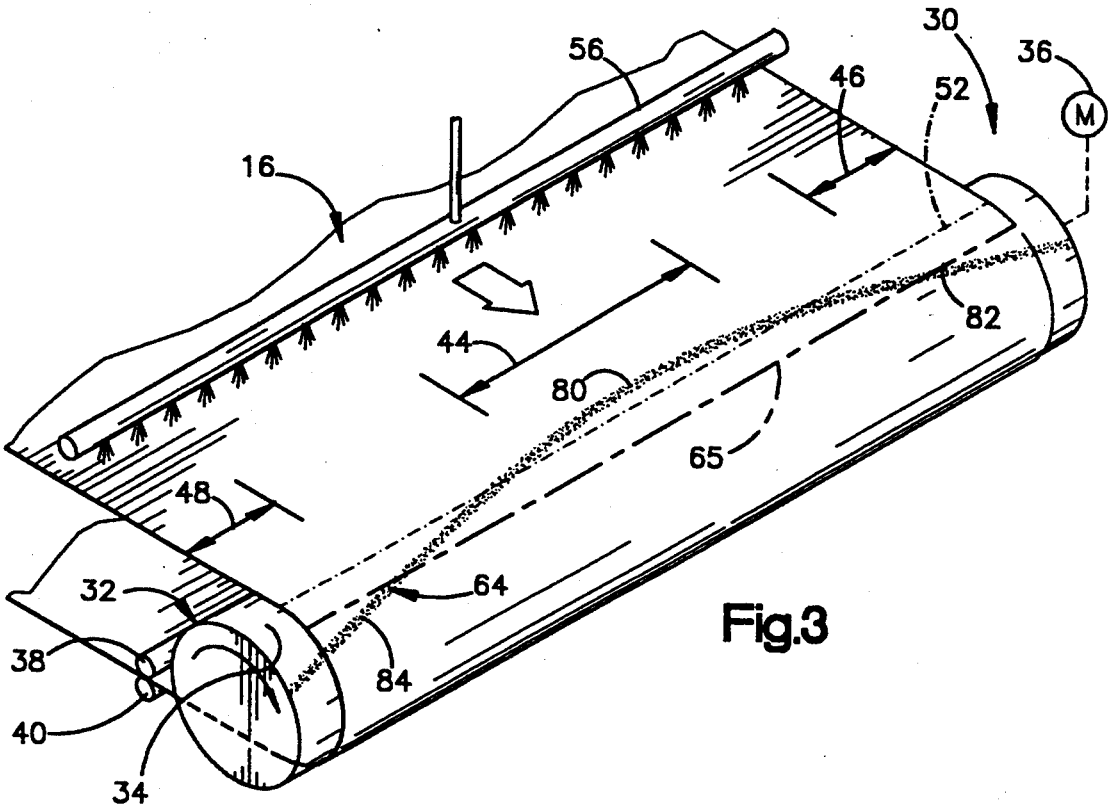
FIG. 3 is a schematic pictorial illustration of an apparatus constructed in accordance with the present invention to transfer heat from a web.

An arcuately curving area 64 of engagement of the flow 60 of air with the web 16 and chill roll 32 has been indicated schematically in FIG. 3. The arcuately bowed configuration of the area 64 matches the arcuately bowed configuration of the nozzle 58, as viewed in FIG. 5. Thus, the nozzle 58 is disposed directly above the area 64 throughout the extent of the area 64. Equal portions of the area 64 are disposed on the upstream and downstream sides of a line 65 which extends across the web 16 and is parallel to the hypothetical line 52 of tangential engagement. The line 65 is located the same distance downstream from the hypothetical line 52 of tangential engagement as the prior art nozzle 22 (FIG. 2) is located from the actual line of tangential engagement.

At the central portion 44 of the web 16, the arcuately bowed area 64 of engagement of the air flow 60 with the web extends ahead, that is upstream, of the hypothetical line 52 of tangential engagement of the web with the chill roll 32. This enables the air flow 60 (FIG. 4) from the nozzle 58 to deflect the central portion 44 of the web 16 downward (as viewed in FIG. 4) into engagement with the cylindrical outer side surface 34 of the chill roll 32 ahead of the hypothetical line 52 of tangential engagement of the web with the chill roll.

A central portion 68 of the nozzle 58 is disposed upstream of the hypothetical line 52 of tangential engagement of the web 16 with the chill roll 32. This results in the arcuately bowed area 64 of engagement of the flow 60 of air with the web 16 (FIG. 3) extending upstream from the hypothetical line 52 of tangential engagement of the web with the chill roll 32.

The arcuate surface area 64 of engagement of the air flow 60 with the surface of the web 16 includes an arcuate central portion 80 (FIG. 3) which is disposed directly beneath and has the same configuration as the central portion 68 of the nozzle 58. The central portion 80 of the surface area 64 extends upstream from the hypothetical line 52 of tangential engagement of the web with the chill roll 32. The central portion 80 of the surface area 64 is aligned with the central portion 44 of the web 16.

Opposite side portions 74 and 76 (FIG. 5) of the nozzle 58 extend downstream from the central portion 68 of the nozzle 58. The arcuately bowed surface area 64 (FIG. 3) of engagement of the flow 60 of air with the surface of the web 16 includes opposite side portions 82 and 84. The side portions 82 and 84 of the surface area 64 extend downstream from the central portion 80 of the surface area 64. The side portions 82 and 84 of the area 64 are disposed downstream from the hypothetical line 52 of tangential engagement of the web 16 with the chill roll 32. The side portions 82 and 84 of the area 64 are disposed directly beneath and have the same configuration as the side portions 74 and 76 (FIG. 5) of the nozzle 58.

The central portion 44 (FIG. 3) of the web 16 engages the chill roll 32 upstream from the hypothetical line 52 of tangential engagement of the web with the chill roll. The opposite edge portions 46 and 48 of the web 16 engage the chill roll 32 at the hypothetical line 52 of tangential engagement of the web with the chill roll. The opposite edge portions 46 and 48 off the web 16 are pressed against the chill roll 34 at the side portions 82 and 84 of the area 64 after the edge portions of the web have engaged the chill roll.

By having the central portion 80 of the area 64 of engagement of the air flow 60 with the web 16 upstream or ahead of the side portions 82 and 84 of the area 64, there is a smoothing of wrinkles away from the central portion 44 of the web toward opposite edge portions 46 and 48 of the web. This smoothing of wrinkles away from the central portion 44 of the web 16 is promoted by having the central portion of the web deflected into engagement with the cylindrical side surface 34 of the chill roll 32 ahead of the hypothetical line 52 of tangential engagement of the web with the chill roll 32.

Figure 6:
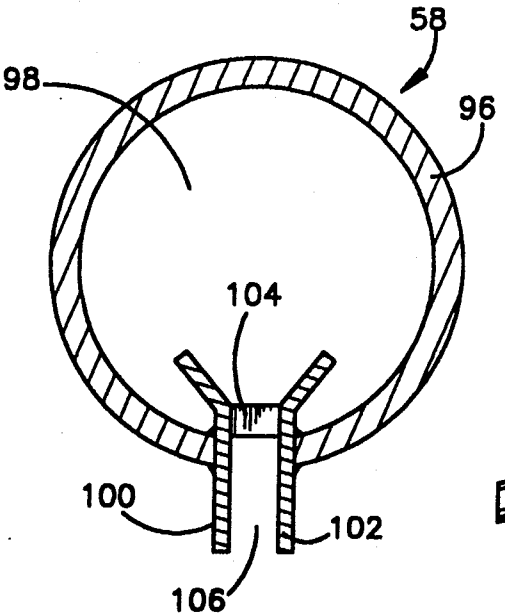
FIG. 6 is a sectional view, taken generally along the line 6—6 of FIG. 5, further illustrating the construction of the nozzle.

It is contemplated that the nozzle 58 could have many different constructions. However, in the illustrated embodiment of the invention, the nozzle 58 includes a generally cylindrical housing 96 (FIG. 6) in which a manifold chamber 98 is disposed. A pair of side plates 100 and 102 extend from the housing 96 and form a nozzle through which air flow is directed toward the web 16.

In the illustrated embodiment of the nozzle 58, spacer blocks 104 are provided between the plates 100 and 102. The spacer blocks 104 divide a slot 106 formed between the plates 100 and 102 into a plurality of oblong openings through which air is conducted from the manifold chamber 98. However, it is contemplated that the nozzle 58 could be provided with a continuous open slot 106 or with a large number of relatively small circular openings through which the air is directed toward the web 16.

In one specific embodiment, the nozzle 58 (FIG. 5) was a segment of a circle having a cord length of 54 inches, the length of the chill roll 32 with which the nozzle was associated. For this specific nozzle 58, the height of the nozzle arc over the cord was approximately three inches. The nozzle 58 had an arc radius of approximately 244 inches. The spacing between this nozzle and the web, that is the radial distance from the lower side of the nozzle to the web, was approximately one-tenth inch (0.10") throughout the length of the nozzle. The width of the nozzle slot 106 (FIG. 6) was approximately 0.060 inches.

It should be understood that the foregoing specific dimensions for the nozzle 58 have been set forth herein for purposes of clarity of description. It is contemplated that the nozzle 58 will be constructed with dimensions which are different than these specific dimensions.

Second Embodiment

Figure 7:
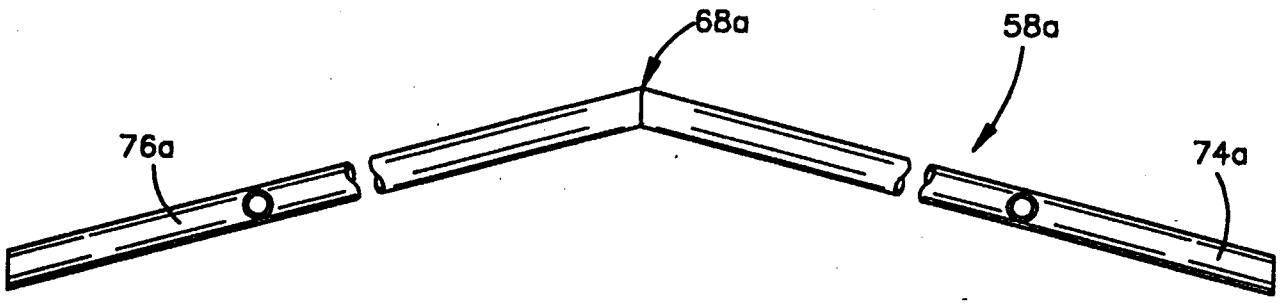
FIG. 7 is a plan view of a second embodiment of the nozzle.

In the embodiment of the invention illustrated in FIGS. 3–6, the nozzle 58 has an arcuately curving configuration. In the embodiment of the invention illustrated in FIG. 7, the nozzle is formed with a V-shaped configuration. Since the embodiment of the invention illustrated in FIG. 7 is generally similar to the embodiment of the invention illustrated in FIGS. 1–6, similar numerals will be utilized to indicate similar components, the suffix letter "a" being added to the numerals of FIG. 7 to avoid confusion.

The generally V-shaped nozzle **58*a* has a central or apex portion 68*a*. Linear side portions 74*a* and 76*a* extend outwardly from the apex portion 68*a*. When the nozzle 58*a* is associated with a chill roll, it is contemplated that the apex or central portion 68*a* of the nozzle will extend ahead or upstream of a hypothetical line of tangential engagement, corresponding to the hypothetical line 52 of tangential engagement in FIG. 3, of the web with the chill roll. The opposite side portions 74*a* and 76*a* of the nozzle 58*a*** will extend downstream from the hypothetical line of tangential engagement of the web with the chill roll.

It should be understood that the nozzle **58*a* extends circumferentially around a portion of the cylindrical outer side surface of the chill roll and, when viewed in a plane extending perpendicular to the central axis of the chill roll, has a center of curvature which is disposed on the central axis of the chill roll. This results in the lower side of the nozzle 58*a*** being spaced the same uniform distance from the cylindrical outer side surface of the chill roll throughout the length of the nozzle.

The V-shaped nozzle **58*a* has a sharply defined angle at the apex portion 68*a*. However, if desired, the apex portion 68*a* could have an arcuate configuration (as viewed in FIG. 7**).

Conclusion

In view of the foregoing description, it is apparent that an improved apparatus 30 for use with a web 16 includes a roll 32. The web 16 moves along a path which extends around the roll 32. A central portion 44 of the web 16 is deflected to engage the outer side surface 34 of the roll 32 upstream from areas of engagement of opposite side portions 46 and 48 of the web with the roll. The apparatus 30 is advantageously used with a chill roll to transfer heat from the web 16.

In one specific embodiment of the invention, a nozzle 58 directs a flow of air toward the web 16 to deflect the central portion 44 of the web into engagement with the chill roll 32 prior to engagement of opposite edge portions 46 and 48 of the web with the chill roll. Opposite side portions 74 and 76 of the nozzle 58 extended downstream from a central portion 68 of the nozzle to direct a flow of air against opposite edge portions 46 and 48 of the web 16.

The nozzle may have a V-shaped configuration (FIG. 7) or an arcuately bowed configuration (FIG. 5). With either configuration, the nozzle may extend part way around the chill roll 32 (FIG. 4) and have a center of curvature which lies on the central axis of the chill roll.

Having described the invention, the following is claimed:

1. An apparatus for use with a web, said apparatus comprising a roll having a cylindrical outer side surface, means for rotating said roll, means for moving the web along a path which extends part way around said roll, and means for causing a central portion of the web to engage the cylindrical outer side surface of said roll upstream of engagement of opposite edge portions of the web with said roll by deflecting the central portion of the web toward the outer side surface of the roll at a location ahead of a hypothetical line of tangential engagement of the web with said roll, said means for causing a central portion of the web to engage the cylindrical outer side surface of said roll includes nozzle means for directing a flow of air toward a surface area of the web, said surface area of the web toward which a flow of air is directed by said nozzle means extends in opposite directions from a location upstream of the hypothetical line of tangential engagement of the web with said roll to opposite edge portions of the web, said nozzle means having a generally V-shaped configuration with an apex portion of said nozzle means at least partially disposed upstream of the hypothetical line of tangential engagement of the web with said roll.

2. An apparatus as set forth in claim 1 wherein said nozzle means has an arcuate configuration as viewed in a plane extending perpendicular to a central axis of said roll.

3. An apparatus as set forth in claim 1 wherein said nozzle means has an arcuate configuration with a center of curvature on a central axis of said roll.

4. An apparatus as set forth in claim 1 wherein said nozzle means has a lower side portion from which air is discharged toward the web, said lower side portion of said nozzle means having a central portion which is disposed upstream of the hypothetical line of tangential engagement of the web with the roll and opposite side portions which extend downstream of the hypothetical line of tangential engagement of the web with the roll, said lower side portion of said nozzle means being spaced the same distance from the cylindrical outer side surface of said roll throughout the extent of the lower side portion of said nozzle means.

5. An apparatus for use with a web, said apparatus comprising a roll having a cylindrical outer side surface, means for rotating said roll, means for moving the web along a path which extends part way around said roll, and means for causing a central portion of the web to engage the cylindrical outer side surface of said roll upstream of engagement of opposite edge portions of the web with said roll by deflecting the central portion of the web toward the outer side surface of the roll at a location ahead of a hypothetical line of tangential engagement of the web with said roll, said means for causing a central portion of the web to engage the cylindrical outer side surface of said roll includes nozzle means for directing a flow of air toward a surface area of the web, said surface area of the web toward which a flow of air is directed by said nozzle means extends in opposite directions from a location upstream of the hypothetical line of tangential engagement of the web with said roll to opposite edge portions of the web, said nozzle means having an arcuately bowed central portion disposed upstream of the hypothetical line of tangential engagement of the web with said roll and opposite side portions which extend away from the central portion of said nozzle means and extend downstream of the hypothetical line of tangential engagement of the web with said roll.

6. An apparatus as set forth in claim 5 wherein said nozzle means has an arcuate configuration as viewed in a plane extending perpendicular to a central axis of said roll.

7. An apparatus as set forth in claim 5 wherein said nozzle means has an arcuate configuration with a center of curvature on a central axis of said roll.

8. An apparatus as set forth in claim 5 wherein said nozzle means has a lower side portion from which air is discharged toward the web, said lower side portion of said nozzle means having a central portion which is disposed upstream of the hypothetical line of tangential engagement of the web with the roll and opposite side portions which extend downstream of the hypothetical line of tangential engagement of the web with the roll, said lower side portion of said nozzle means being spaced the same distance from the cylindrical outer side surface of said roll throughout the extent of the lower side portion of said nozzle means.

9. An apparatus for use in transferring heat from a web, said apparatus comprising a rotatable chill roll having a cylindrical outer side surface along which the web moves during rotation of said chill roll, and nozzle means for directing a flow of air toward a side surface of the web, said nozzle means extending between opposite edge portions of the web and extending circumferentially around a portion of the outer side surface of said chill roll, said nozzle means having an arcuate configuration with a center of curvature on the axis of rotation of said chill roll, said nozzle means includes a central portion which directs a flow of air toward a central portion of the web and opposite side portions which extend downstream from the central portion and direct a flow of air toward opposite edge portions of the web.

10. An apparatus as set forth in claim 9 wherein said nozzle means has a generally V-shaped configuration with an apex portion of said nozzle means aligned with a central portion of the web.

11. An apparatus as set forth in claim 9 wherein said nozzle means has an arcuately bowed configuration as viewed in a plane extending parallel to a central axis of said chill roll.

12. An apparatus as set forth in claim 11 wherein said nozzle means is spaced from the cylindrical outer side surface of said chill roll by the same distance throughout the extent of said nozzle means.

13. An apparatus as set forth in claim 9 further including means for applying moisture to the web upstream of said chill roll.

14. An apparatus for use in transferring heat from a web, said apparatus comprising a rotatable chill roll having a cylindrical outer side surface along which the web moves during rotation of said chill roll, and nozzle means for directing a flow of air toward a side surface of the web, said nozzle means extending between opposite edge portions of the web and extending circumferentially around a portion of the outer side surface of said chill roll, said nozzle means having an arcuate configuration with a center of curvature on the axis of rotation of said chill roll, said nozzle means having a generally V-shaped configuration with an apex portion of said nozzle means aligned with a central portion of the web.

15. An apparatus as set forth in claim 14 wherein said nozzle means is spaced from the cylindrical outer side surface of said chill roll by the same distance throughout the extent of said nozzle means.

16. An apparatus as set forth in claim 14 further including means for applying moisture to the web upstream of said chill roll.

17. An apparatus for use in transferring heat from a web, said apparatus comprising a rotatable chill roll having a cylindrical outer side surface along which the web moves during rotation of said chill roll, and nozzle means for directing a flow of air toward a side surface of the web, said nozzle means extending between opposite edge portions of the web and extending circumferentially around a portion of the outer side surface of said chill roll, said nozzle means having an arcuate configuration with a center of curvature on the axis of rotation of said chill roll, said nozzle means having an arcuately bowed configuration as viewed in a plane extending parallel to a central axis of said chill roll.

18. An apparatus as set forth in claim 17 wherein said nozzle means is spaced from the cylindrical outer side surface of said chill roll by the same distance throughout the extent of said nozzle means.

19. An apparatus as set forth in claim 17 further including means for applying moisture to the web upstream of said chill roll.

20. A method of transferring heat from a web, said method comprising the steps of moving the web around a rotatable chill roll and transferring heat from the web to an outer side surface of the chill roll, said step of moving the web around the chill roll includes moving a central portion of the web into initial engagement with the outer side surface of the chill roll and moving opposite edge portions of the web into initial engagement with the outer side surface of the chill roll at locations disposed downstream from the location where the central portion of the web initially engages the outer side surface of the chill roll, said step of moving a central portion of the web into initial engagement with the outer side surface of the chill roll includes applying fluid pressure against the central portion of the web to deflect the central portion of the web toward the outer side surface of the chill roll.

21. A method as set forth in claim 20 further including applying fluid pressure against opposite edge portions of the web at locations downstream from the location where fluid pressure is applied against the central portion of the web to press the opposite edge portions of the web against the outer side surface of the chill roll.

22. A method as set forth in claim 20 wherein said steps of moving a central portion of the web into initial engagement with the outer side surface of the chill roll and moving opposite edge portions of the web into initial engagement with the outer side surface of the chill roll includes deflecting the web at a location upstream from the locations where the opposite edge potions of the web initially engage the chill roll and maintaining the web in a deflected condition as the opposite edge portions of the web move into initial engagement with the chill roll.

23. An apparatus for use with a web, said apparatus comprising a roll having a cylindrical outer side surface, means for rotating said roll, means for moving the web along a path which extends part way around said roll, and means for causing a central portion of the web to initially engage the cylindrical outer side surface of said roll upstream of locations where opposite edge portions of the web initially engage the cylindrical outer side surface of said roll by deflecting the central portion of the web toward the outer side surface of the roll at a location ahead of a hypothetical line of tangential engagement of the web with said roll, said means for causing a central portion of the web to engage the cylindrical outer side surface of said roll includes nozzle means for directing a flow of air toward a surface area of the web, said surface area of the web toward which a flow of air is directed by said nozzle means having an upstream edge portion which extends downstream in opposite directions from a location upstream of the hypothetical line of tangential engagement of the web with said roll to opposite edge portions of the web.

24. An apparatus as set forth in claim 23 wherein said nozzle means has a generally V-shaped configuration with an apex portion of said nozzle means at least partially disposed upstream of the hypothetical line of tangential engagement of the web with said roll.

25. An apparatus as set forth in claim 23 wherein said nozzle means has an arcuately bowed central portion disposed upstream of the hypothetical line of tangential engagement of the web with said roll and opposite side portions which extend away from the central portion of said nozzle means and extend downstream of the hypothetical line of tangential engagement of the web with said roll.

26. An apparatus as set forth in claim 23 wherein said nozzle means has an arcuate configuration as viewed in a plane extending perpendicular to a central axis of said roll.

27. An apparatus as set forth in claim 23 wherein said nozzle means has an arcuate configuration with a center of curvature on a central axis of said roll.

28. An apparatus as set forth in claim 23 wherein said nozzle means has a lower side portion from which air is discharged toward the web, said lower side portion of said nozzle means having a central portion which is disposed upstream of the hypothetical line of tangential engagement of the web with the roll and opposite side portions which extend downstream of the hypothetical line of tangential engagement of the web with the roll, said lower side portion of said nozzle means being spaced the same distance from the cylindrical outer side surface of said roll throughout the extent of the lower side portion of said nozzle means.

29. An apparatus as set forth in claim 23 wherein said nozzle means is spaced from the cylindrical outer side surface of said roll by the same distance throughout the extent of said nozzle means.

30. A method of transferring heat from a web, said method comprising the steps of moving the web around a rotatable chill roll and transferring heat from the web to an outer side surface of the chill roll, said step of moving the web around the chill roll includes moving a central portion of the web into initial engagement with the outer side surface of the chill roll and moving opposite edge portions of the web into initial engagement with the outer side surface of the chill roll at locations disposed downstream from the location where the central portion of the web initially engages the outer side surface of the chill roll.

31. A method as set forth in claim 30 wherein said steps of moving a central portion of the web into initial engagement with the outer side surface of the chill roll and moving opposite edge portions of the web into initial engagement with the outer side surface of the chill roll includes deflecting the web at a location upstream from the locations where the opposite edge potions of the web initially engage the chill roll and maintaining the web in a deflected condition as the opposite edge portions of the web move into initial engagement with the chill roll.

* * * * *